United States Patent [19]

Taravel

[11] Patent Number: 4,633,542

[45] Date of Patent: Jan. 6, 1987

[54] BRUSH HAVING RESILIENTLY RETRACTABLE BRISTLES, IN PARTICULAR FOR BRUSHING SURFACES OF COMPLEX SHAPE, SUCH AS TEETH

[75] Inventor: Bernard Taravel, Angers, France

[73] Assignee: Laboratoires Pharmascience, Courbevoie, France

[21] Appl. No.: 722,445

[22] Filed: Apr. 12, 1985

[30] Foreign Application Priority Data

Apr. 13, 1984 [FR] France ..... 84 05896

[51] Int. Cl.[4] ..... A46B 9/04

[52] U.S. Cl. ..... 15/167 R; 15/201

[58] Field of Search ..... 15/167 R, 167 A, 201, 15/191 R, 190; 132/84 R

[56] References Cited

U.S. PATENT DOCUMENTS 2,882,544 4/1959 Hadidian .
2,935,755 5/1960 Leira .
3,082,457 3/1963 Lucibello .
3,129,449 4/1964 Cyzer ..... 15/201 X
4,240,451 12/1980 Jean .

FOREIGN PATENT DOCUMENTS 2909638 9/1980 Fed. Rep. of Germany .
1221793 2/1971 United Kingdom .

*Primary Examiner*—Peter Feldman
*Attorney, Agent, or Firm*—Thomas J. Greer, Jr.

[57] ABSTRACT

Tufts of bristles (3) in a brush are resiliently retractable by thrusting against a membrane (5) which is capable of resilient spot deformation, with each tuft being retractable independently from the other tufts of the brush. Tufts are retracted into the brush in order to continuously match the envelope surface (18) defined by the free ends (15) of said tufts (3) to the shape of the surface to be brushed (17), and said matching takes place without substantial difference in the force applied to the various zones of said surface by the various tufts of bristles.

15 Claims, 5 Drawing Figures

BRUSH HAVING RESILIENTLY RETRACTABLE BRISTLES, IN PARTICULAR FOR BRUSHING SURFACES OF COMPLEX SHAPE, SUCH AS TEETH

The present invention relates to a brush having retractable bristles, in particular for brushing surfaces of complex shape, such as teeth, for example.

BACKGROUND OF THE INVENTION

Conventional brushes comprise tufts of bristles each having a first end which is held captive in and which is fixed to a brush head, and a second end which is free and which is used for brushing. The free ends of the various tufts present a surface envelope which is capable of slight deformation by the bristles bending when they come into contact with a surface to be brushed, but which is incapable of adequately matching a surface having a complex shape with too much difference in level. In particular, contact with adequate pressure is not ensured in the hollows of such a surface to provide proper brushing.

Thus, with toothbrushes, the desire of the user to cause the bristles to penetrate into the space between teeth as expressed by forceful application of the brush against the teeth merely leads to excessive application of the brush against the teeth and the gums without providing adequate brushing in the space between the teeth. The final result is unsatisfactory.

An object of the present invention is to remedy this defect by providing a brush in which the tufts of bristles are capable, independently of one another, of retracting resiliently into the brush in such a manner as to enable the surface envelope defined by the free ends of said tufts to continuously match the shape of the surface to be brushed, without any major difference in the force applied to the various zones of said surface by the various tufts of bristles.

SUMMARY OF THE INVENTION

To this end, the present invention provides a brush comprising a rigid brush head and a predetermined number of tufts of bristles, with each tuft having a first end held captive in the brush head and a free second end intended to come into contact with a surface to be brushed, the brush head comprising:

a rigid brush head wall having a first face, a second face, and a plurality of openings passing through said wall from the first face to the second face thereof along respective predetermined axes, there being as many of said openings as there are tufts of bristles, and each opening receiving a respective one of said tufts, said tufts being slidable in said openings along respective ones of said axes, each tuft thus being oriented along a corresponding axis and having its second end projecting from the second face of the wall, and an intermediate zone in between said first and second ends which is engaged in a corresponding one of said openings, said intermediate zones and said openings having respective complementary cross-sections in a direction perpendicular to the corresponding axes;

a resiliently deformable membrane capable of spot deformation superposed on the first face of the wall over said openings and said first ends of said tufts, said membrane being independent therefrom, and having a peripheral zone which is fixed over its entire length to said brush head, said membrane being held taut by said brush head;

means for enabling resilient spot deformation of the membrane opposite said openings and said first ends of said tufts, and in a direction away from said first face of the wall;

stop means imposing a limit on the sliding of each tuft in the direction away from said first face towards said second face of the wall to ensure contact between said first end of each tuft and said membrane;

the brush including the improvement whereby said resilient spot deformation of the membrane is made possible by said brush head including a cavity facing the set of openings through the wall, said cavity being common to all of said openings and being on the opposite side of said membrane from said first face of the wall, and said membrane being made of an isotropic material and behaving anisotropically in such a manner that the tufts of bristles are capable of retracting resiliently into said cavity independently from one another.

The notion of the membrane having anisotropic behavior, in association with the notion the membrane being capable of resilient spot deformation covers the possibility of highly localized zones of the membrane being resiliently displaced relative to the rest of the membrane without affecting the immediately adjacent zones, or more precisely of resiliently displacing a zone of contact between a first end of any given tuft and the membrane relative to the rest of the membrane without displacing the contact zones between the first ends of respective immediately adjacent tufts and the membrane. The notion of the membrane being taut covers the generally accepted sense of "not slack". The membrane is preferably under tension since that facilitates spot deformation in the thickness direction thereof.

U.S. Pat. Nos. 2,882,544 and 3,082,457 have already proposed slidably mounting tufts of bristles in openings through a rigid wall in the head of a brush, and of urging said tufts within the brush head against a resilient return membrane. In this prior art, the localized character of resilient membrane deformation, i.e. the independence of the various tufts in retraction and in resilient return is not due to a characteristic of the membrane but rather to a rigid grid which is applied thereto on its face opposite to its face which comes into contact with the sliding tufts. The rigid grid constrains the membrane to deform in respect of each tuft only in a zone which is immediately adjacent thereto. As each tuft is retracted, the corresponding zone of the membrane is forced to a greater or lesser extent into the grid, and this leads to constraints having a harmful effect on the lifetime of the membrane. This prior art operates on the principle that in order to enable any tuft to be resiliently retractable independently from the other tufts, it is necessary to associate a resilient return member with each tuft which is proper thereto. The grid serves to divide the membrane into as many zones as there are tufts and to ensure that each of these zones is independent of any other zone. This line of thinking is exemplified by another embodiment described in the earlier of the above-mentioned U.S. patents, in which the resilient membrane and the associated grid are omitted and each tuft is associated with a corresponding helical return spring.

The present invention operates on a radically different principle in that the various tufts of bristles which define a discontinuous structure by virtue of their totally independent mounts co-operate with a single return member which is continuous from one tuft to the next but which nevertheless ensures independence of movement and resilient return for the various tufts by virtue of a characteristic proper to said return member, i.e. the membrane, rather than by the structural artifice of pressing the membrane against a grid. The membrane of a brush made in accordance with the present invention and which is consequently subjected to forces that are due to its inherent deformation capabilities, necessarily has increased lifetime over the membrane of a brush made in accordance with the teaching of the two above-mentioned U.S. patents.

BRIEF DESCRIPTION OF THE DRAWINGS

Embodiments of the invention are described by way of example with reference to the accompanying drawings, in which.

MORE DETAILED DESCRIPTION

Although the figures illustrate a toothbrush, the present invention is naturally also applicable to other types of brush, and persons skilled in the art will adapt the present description to such brushes. For example, without going beyond the scope of the claims, the invention could be applied to brushes used for providing sealing between two relatively movable members.

Figure 1:
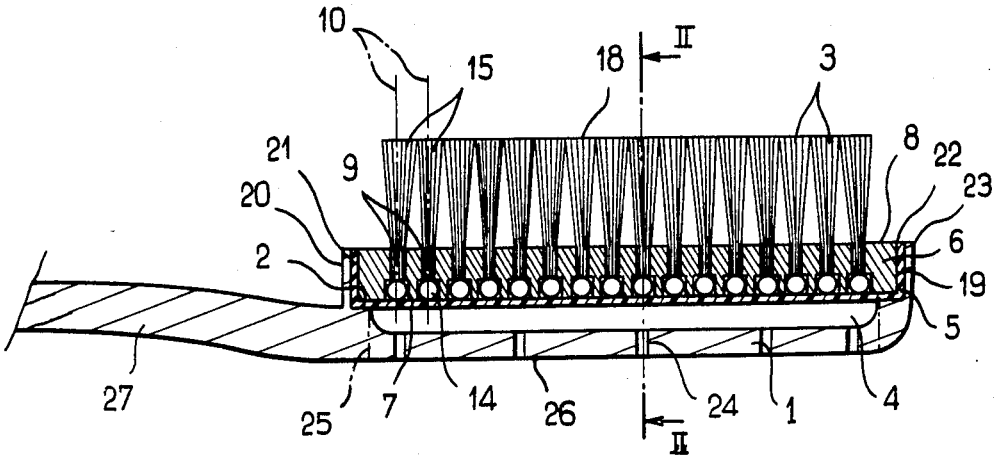
FIG. 1 is a longitudinal section through a toothbrush made in accordance with the invention, and on a plane I—I of FIG. 2.
Figure 2:
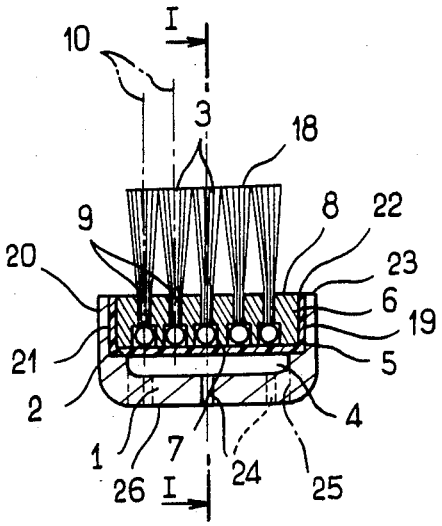
FIG. 2 is a cross-section through the FIG. 1 brush on a plane II—II of FIG. 1.
Figure 3:
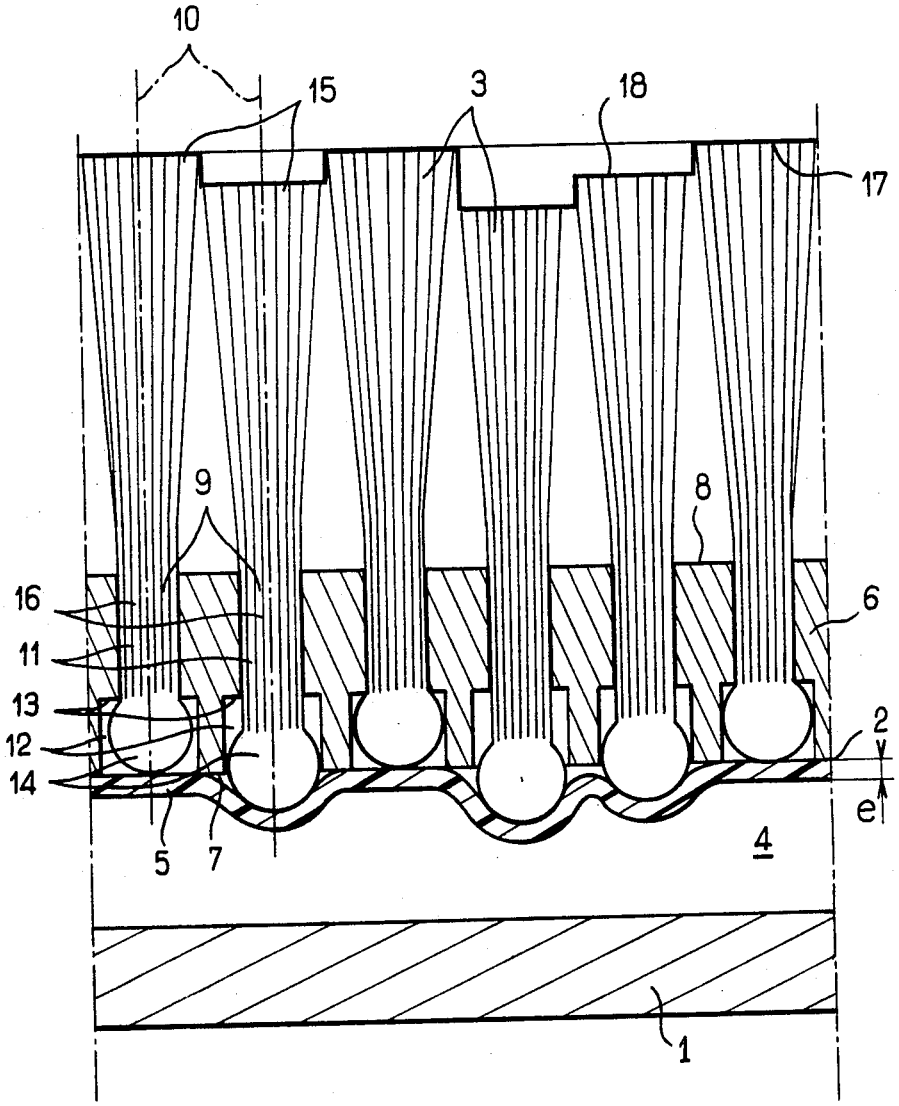
FIG. 3 shows a detail of FIG. 1 to larger scale and demonstrates how tufts of bristles in a brush made in accordance with the present invention are capable of retracting resiliently.

In FIGS. 1 to 3, reference 1 designates a flat brush head for a toothbrush, the head is fixed to a handle 27 and has a flat face 2 from which a plurality of tufts 3 of bristles project, said tufts being disposed approximately parallel to one another and perpendicular to the face 2.

The face 2 is hollowed out to provide a cavity 4 which is completely surrounded by the face 2, and which is closed at the face 2 by a membrane 5 made of an isotropic elastomer material which is selected for its suitability for giving the membrane made thereof the possibility of being subjected to resilient deformation in localized spots by virtue of the anisotropic character of a membrane as defined above. A natural rubber-based film of the kind used for manufacturing advertizing balloons has been successfully used as the membrane 5. Its thickness e was about 3 tenths of a millimeter.

The membrane is fixed while taut to the brush head 1 on the flat face 2 thereof and around the entire periphery of the cavity 4 which is closed by the membrane 5 in sealed manner, such that the cavity and the membrane enclose a cushion of air whose presence advantageously increases the characteristic facilitating spot deformation of the membrane in the direction of its thickness. In a variant, the cavity 4 may be opened by means enabling air to flow freely between the inside of the cavity 4 and the outside of brush which contains the medium in which the brush is used, e.g. an aqueous toothpaste medium if the brush is a toothbrush. Holes 24 may be provided for this purpose through the brush head 1, or alternatively, the entire brush head may be in the form of a ring leaving one face 26 of the cavity 4 completely open opposite to face 2. This has been marked by dot-dashed lines 25 in FIGS. 1 and 2.

On the other side of the membrane 5 from the cavity 4 there is a plate 6 which is made of rigid material, e.g. plastic material, like the remainder of the brush head 1.

The plate 6 is fixed to the brush head 1, and together therewith it clamps the membrane 5 in continuous manner all around the periphery of the cavity 4. The plate 6 thus forms a rigid extension of the head 1, and in other embodiments of the brush it could be integrally molded therewith, as will be more clearly understood from the description of FIGS. 4 and 5.

The plate 6 has a first flat face 7 facing the membrane 5 and which is in flat contact therewith when the membrane 5 is taut. The other face 8 of the plate 6 is also flat and is parallel to the face 7, but faces away from the membrane 5 and the brush head 1.

These two faces 7 and 8 are interconnected by a side surface 19 which is substantially perpendicular thereto and which is received within a continuous rim 20 which the brush head 1 presents around its face 2. This rim projects therefrom substantially perpendicularly and extends away from the cavity 4. Advantageously, a continuous peripheral zone 21 of the membrane 5 is clamped between the side 19 of the plate 6 and the rim 20 of the face 2, thereby fixing the membrane to the head 1 and to the plate 6 and ensuring that all three parts are fixed relative to one another. The fixing may be improved by gluing or by heat welding the plate 6 to the rim 20 around the edge 22 of the side 19 and the face 8 of the plate 6 and the end 23 of the rim 20 which is substantially level with the face 8 of the plate 6 around the membrane 5. Other means may be selected for fixing the plate 6 to the brush head 1 and the periphery of the membrane 5 without going beyond the scope of the present invention. It may be observed that the membrane remains free to move relative to the plate 6 and relative to the brush head 1, in front of the cavity 4.

Openings 9 pass right through the plate 6 approximately perpendicularly to the faces 7 and 8 in front of the cavity 4. There is one such opening for each tuft 3, and each opening 9 receives one tuft.

To this end, each opening 9 has two cylindrical zones of revolution about a common axis 10 which is approximately perpendicular to the faces 7 and 8. One of said zones is a zone 11 which is of smaller diameter and which is adjacent to the face 8 of the plate 6, and the other is a zone 12 which is of larger diameter and which is adjacent to the face 7. The zones 11 and 12 are interconnected by an annular shoulder 13 which is perpendicular to the axis 10.

For any given opening 9 and the corresponding tuft 3, the tuft has a first end 14 which is mounted in the brush head and which is held captive therein, and a second or brushing end 15 which is free. Between its ends 14 and 15, each tuft 3 has an intermediate zone 16 which is slidably mounted along the axis 10 inside the zone 11 of the corresponding opening 9, and to this end the cross-section of the tuft is as close as possible to that of the zone 11. However, in the vicinity of its first end 14, the cross-section of each tuft is greater than that of the zone 11 while being no greater than that of the zone 12 of the opening 9, thereby enabling the tuft to be held captive between the shoulder 13 and the membrane 5 and being left free to move away from the shoulder 13 into the cavity 4 by elastically deforming the membrane 5 and to return to a position in which it abuts against the shoulder 13, but being prevented from moving further in a direction towards the face 8 of the plate 6. Advantageously, the bristles of the tuft 3 are agglomerated in the intermediate zone 16 where they slide in the zone 11 of the opening 9, e.g. by welding if the bristles are made of synthetic material, as is often the case. In such a situation, the increased cross-section of each tuft at its first end 14 may advantageously be obtained by melting the bristles thereof or by any other suitable means. In any event, the first end 14 of each tuft 3 remains independent from the membrane 5, i.e. it is not fixed thereto. The bristles of each tuft are nonetheless independent of one another between the intermediate zone 16 and the second end 15 of the tuft, and this region of mutual independence extends over a sufficient length to ensure that the bristles of the tuft have the desired flexibility.

When the brush is at rest, i.e. when no pressure is applied to the tufts 3 urging them towards the cavity 4 along their respective axes 10, the membrane 5 is taut and keeps the first ends 14 of the various tufts 3 abutting against the respective shoulders 13 as shown in FIGS. 1 and 2. The second ends 15 of the various tufts then define an envelope surface 18 which is smooth, and may for example be plane.

When the tufts 3 are brought into contact with a surface 17 having a shape other than complementary to the envelope surface 18 (e.g. as shown in FIG. 3) by applying pressure approximately parallel to the axes 10, forces are applied to the tufts 3 approximately along the respective axes 10, thereby causing the tufts 3 which are in contact with the relatively projecting zones of the surface 17 to retract by sliding along their respective openings 9 along their respective axes 10, and causing resilient spot deformation of the membrane 5 where it is urged into the cavity 4 by the first ends 14 of said tufts. The absence of membrane deformation in the vicinity of the other tufts maintains these other tufts in a relatively projecting position compared with the tufts which come into contact with the projecting zones of the surface 17, thereby enabling the free ends of the tufts of bristles to engage both the hollows and the crests of the surface 17. The shape of the envelope 18 thus changes to accurately match that of the surface 17. When the brush is moved over the surface 17, the tufts 3 which move away from the projecting portions of the surface 17 tend to return to their initial positions by sliding in the opposite direction under the urging or the membrane 5 which tends resiliently to return to its initial shape, thereby bringing the first ends 14 of said tufts into contact with the corresponding shoulders 13, while other tufts 3 which are brought into contact with said relatively projecting zones are in turn retracted in the above-described manner. When the brush is finally removed from the surface 17, all of the tufts 3 return to their initial positions, with their respective first ends 14 abutting against the corresponding shoulders 13 by virtue of the resilient membrane 5 returning to its own initial position.

Naturally, numerous variants of the above-described device could be provided.

The shape of the surface envelope 18 and the shape of face 2 of the brush head and the face 7 of the plate 6 (i.e. the shape of the membrane 5 when held taut against the plate 6) may be selected to be different from those described. Likewise, the shape and the nature of the tufts 3 and their distribution may be selected at will, and may optionally be varied to give different characteristics to different regions of the same brush.

Further, the structure of the brush head and the way in which the membrane is connected thereto may vary over a wide range. In particular, instead of being applied to the brush head opposite to a cavity therein, the perforated wall which guides the tufts of bristles may be constituted by an integral part of the brush head with the entire periphery of the membrane being fixed thereto by any means which enable the membrane to move freely anywhere else, for example by means of a cover which leaves a cavity to enable said movement except for in a peripheral fixing zone.

Two variant embodiments are described with reference to FIGS. 4 and 5. Like FIGS. 1 to 3, these FIGS. 4 and 5 use a toothbrush as an example. It is recalled that the invention may be used with brushes other than toothbrushes.

Figure 4:
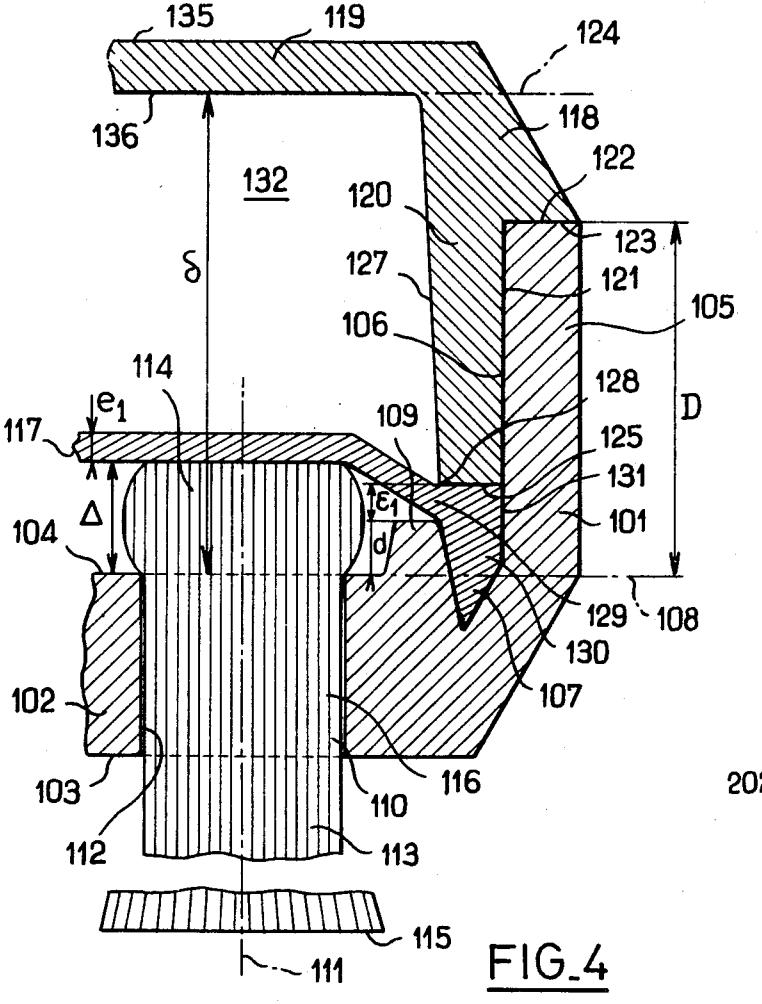

Reference is made initially to FIG. 4 in which a flat brush head 101 is fixed to a handle (not shown) and includes a flat wall 102 which is essentially delimited by two plane faces 103 and 104 which are parallel to one another, and by a rim 105 which surrounds the wall 102 in continuous manner and which projects away from the face 104 thereof to provide a continuous inside peripheral face 106 which is perpendicular to the face 104 and which is separated therefrom. The face 106 is connected to the face 104 by a continuous groove 107 extending behind the plane 108 of the face 104 immediately adjacent to the face 106, and by a second continuous rim 109 connecting the groove 107 to the face 104 and standing proud of the plane 108 by a constant height d while the rim 105, and specially the face 106 thereof, stands proud by a higher constant height D, both heights being measured from the plane 108 of the face 104.

The wall 103 has a plurality of openings 110 passing right through it in the same manner as described with reference to FIGS. 1 to 3. Each opening has its own axis 111 which is perpendicular to the faces 103 and 104, and each opening opens out into said faces. The openings come close to the rim 109 but do not interfere therewith. For example, as shown, each opening 110 is delimited by a circularly cylindrical peripheral face 112 around the corresponding axis 111 and of constant diameter.

Each of the openings 110, like each of the openings 9 through the plate 6, is intended to receive and to guide a corresponding tuft of bristles 113 which is slidably mounted along the corresponding axis 111. The tufts 113 are entirely comparable to the tufts 3 described with reference to FIGS. 1 to 3. In particular, each tuft 113 has a first end 114 which is held captive in the brush head 101 inside the brush head between the flat wall 102 and a membrane 117 as described below, and a second end 115 which is free and which constitutes the brushing end of the tuft. Further, each tuft 113 includes an intermediate zone 116 immediately adjacent to its first end 114 and passing through the flat wall 102 via the corresponding opening 110. As mentioned above, the bristles of the tuft are free from the zone 116 thereof to the second end 115, while said bristles are advantageously agglomerated within the zone 116 so that said zone provides a stable cylindrical envelope about the axis 111 having a diameter which is as close as possible to that of the face 112 of the opening 106, thereby providing a sliding guide between the face 112 and the tuft of bristles 113 along the axis 111 with a minimum of hindrance. The bristles of the tuft are also agglomerated at said first end 114 which is of greater cross-section than the opening 110 so as to provide a stop against the face 104 of the wall 102, limiting displacement of the tuft in a direction going from the face 104 towards the face 103. The size of the tuft 113 along the axis 111 is such, that when its first end 114 abuts against the face 104, the second end 115 is at such a distance from the other face 103 of the wall 102 and from the intermediate zone 116 of the tuft that the bristles of the projecting tuft have the desired degree of flexibility.

Naturally, although only one tuft of bristles 113 and only one opening 110 have been shown in FIG. 4, the person skilled in the art will understand that identical tufts may be disposed in identical openings over the entire extent of the wall 102.

It may be observed that the first end 114 of the tuft 113 projects from the face 104 when abutting thereagainst by a value $\Delta$ which lies between the above-mentioned values D and d, and which is closer to d than to D. Preferably, all of the tufts 113 stand proud from the face 104 by said value $\Delta$, and therefore stand proud from the rim 109 by a value $\Delta-d$ when their first ends 114 are in abutment against the face 104 of the wall 102.

The above-described head 101 has a cover 118 fixed thereto, said cover being in the form of a flat wall 119 delimited by two plane faces 135 and 136 which are mutually parallel, and which are surrounded by a rim 120 which projects from the face 106 away from the wall 119.

With an outer peripheral face 12 thereof which is perpendicular to the plane 124 of the face 126, the rim 120 is encased in the rim 105 of the brush head 101 and engages the inner peripheral face 106 of the rim 105; respective steps 122 and 123 of the rims 105 and 120 mutually abut and are advantageously fixed to each other, e.g. by high frequency welding if the cover 118 and the brush head 101 are made of plastic material, or by any suitable means, in order to define for the cover 118 and the tooth head 101 a relative position in which the face 136 of the wall 119 opposite the face 104 is parallel thereto and spaced therefrom by a distance $\delta$ which is greater than the sum of $\Delta$ and the current thickness $e_1$ of the membrane 17. In the example shown, $\delta$ is also greater than D.

It will be observed that the face 136 has a plane area which is at least equal to that of the face 104 so as to provide a zone opposite each zone of the face 104 in a direction perpendicular thereto, thereby ensuring that there is room between the face 136 and the membrane 117, deemed to be pressed against the ends 114 of the various tufts of of bristles 113 which are themselves in abutment against the face 104, for allowing a movement of the membrane 117 and the first ends 114 of the tufts such as 113 in the said room.

In addition to its outer peripheral face 121, the rim 120 has a continuous edge face 125 which is parallel to the face 136 and which interconnects the outer peripheral face 121 of the rim 120 to an inner peripheral face 127 thereof. Said inner peripheral face 127 interconnecting the edge face 125 to the face 136 is at least approximately perpendicular to both said faces. When the rim 120 is fitted in the rim 105 and the steps 122 and 123 come into mutual abutment, the edge face 125 of the rim 120 comes opposite to the groove 107 in a direction perpendicular to the plane 108 of the face 104 leaving a continuous annular space 129 between the rim 109 and an edge 128 connecting the end face 125 and the inner peripheral face 127 of the rim 120. The width $\epsilon_1$ of this space in a direction perpendicular to the planes 108 and 124 is approximately equal to the current thickness $e_1$ of the membrane 117.

The annular space 129 thus constitutes a relatively narrow neck leading to a relatively broad volume 130 defined by the groove 107 and the face 125 of the rim 120. This disposition is used to hold a continuous peripheral beading 131 on the membrane 117 captive in the groove 107. The beading is thicker than the thickness $e_1$ of the rest of the membrane. The membrane 117 passes through the space 129 without it being possible for its peripheral beading 131 to escape from the space 130. Preferably, the beading 131 has a different free shape than that which takes up when held captive in the space 130 such that it is elastically compressed by being held captive in said space, thereby contributing to being retained therein.

Further, the membrane 117 which has the same mechanical characteristics as the membrane 6 described with reference to FIGS. 1 to 3, is preferably chosen such that when removed from the brush head 101 and the cover 118 it is flat in shape having a uniform thickness $e_1$ (apart from its continuous peripheral beading 131) and is of such a size that once mounted in the brush head 101 with its beading 131 held captive in the space 130 the membrane is pressed against the edge 128 and also against the respective first ends 114 of the adjacent tufts 113 closest to the rim 109 so as to prestress said membrane and keep it under tension even when all the first ends 114 of the tufts of bristles 113 are in abutment against the face 104 of the wall 102.

A brush designed in this manner operates in the same way as a brush of the type illustrated in FIGS. 1 to 3. The face 136 of the flat wall 119 and the face 127 of the rim 120 delimits a single cavity 132 facing the membrane 117 and the set of first ends 114 of the various tufts of bristles 113. This common cavity 132 receives the membrane 117 when it is locally deformed by any one of the tufts of bristles 113 being urged into said cavity 132 approximately parallel to its axis 111. The membrane then exerts a resilient return force on the tuft 113 urging its first end 114 into contact with the face 104 as soon as the deforming face is removed. The cavity 132 may be closed in a sealed manner by the membrane 117 and the cover 118, or, in contrast, if the brush is intended to operate in a liquid medium suitably sized orifices may be provided, e.g. in the cover 118 to enable said medium to flow freely between the cavity 132 and the outside.

Figure 5:
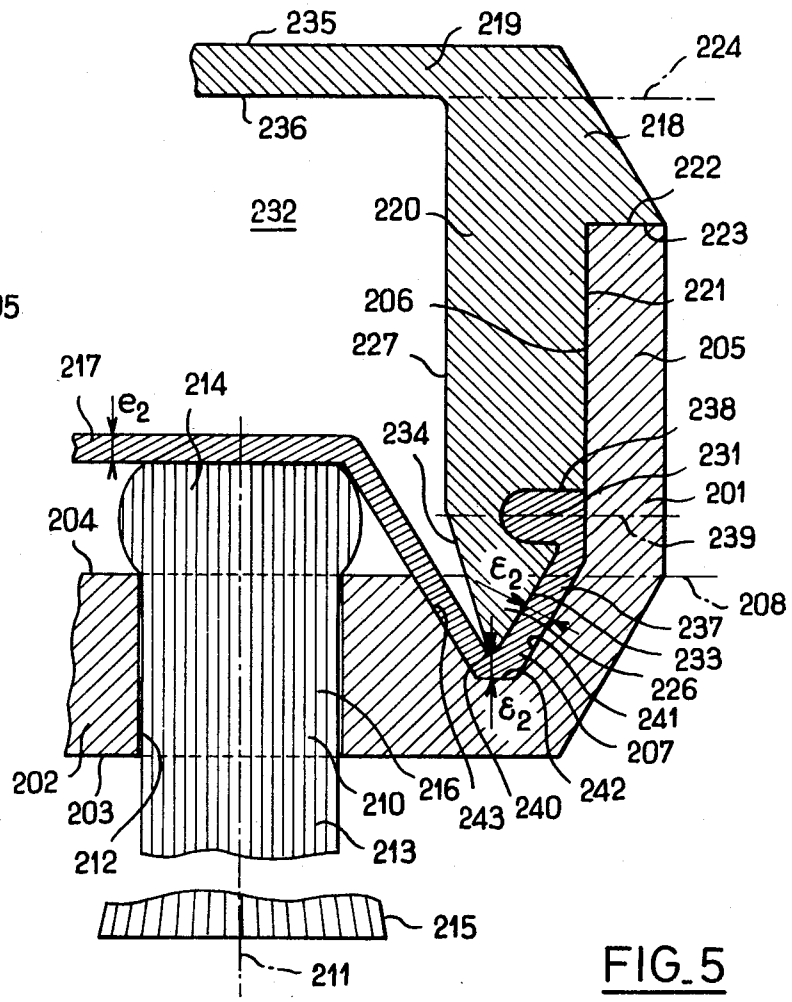
FIGS. 4 and 5 are cross-section views similar to FIG. 2, through a portion of a brush, and to a larger scale, showing two variants of brushes in accordance with the invention.

FIG. 5 illustrates a variant which is very similar to that shown in FIG. 4, and reference numerals 201 to 208, 210 to 224, 226 to 227, 231, 232, 235 and 236 in FIG. 5 designate the same items as described under the references 101 to 108, 110 to 124, 126, 127, 131, 132, 135 and 136 with reference to FIG. 4. Reference will be made to the description of FIG. 4 in what concerns those common items. The description of the FIG. 5 embodiment is therefore restricted to describing the differences between this embodiment and that described with reference to FIG. 4.

Firstly, it can be seen that in the FIG. 5 embodiment the groove 207 which corresponds to the groove 107 runs directly from the inside peripheral face 206 of the rim 205 (corresponding to the inside peripheral face 106 of the rim 105) to the face 204 of the wall 202 corresponding to the face 104 of the wall 102, but without a rim corresponding to the rim 109.

Further, in the FIG. 5 embodiment the outer and inner peripheral faces 221 and 227 of the rim 220 of the cover 218 are no longer interconnected by a flat end face such as the face 125 but are interconnected by two faces 233 and 234 giving the rim 220 a chamfered end 226 which is engaged in the groove 207 of the brush head 201 by means of a peripheral zone 237 of the membrane 217. The membrane 217 has beading 231 surrounding said continuous peripheral zone 237 and received in a continuous peripheral groove 238 in the outer peripheral face 221 of the rim 220 of the cover 218. This groove is located in the join between the faces 233 and 221 opposite the face 206 of the rim 205 of the brush head 201. A mid plane 239 of the groove 238 lies between the planes 208 and 224 of the faces 204 and 236, but is closer to the plane 208 than to the plane 224. Directly opposite the face 233, in between the groove 238 and a rounded edge 240 between the faces 233 and 234, the groove 207 has a sloping face 241 parallel to the face 233 at a distance $\epsilon_2$ therefrom, where $\epsilon_2$ is similar in value to the thickness $e_2$ of the membrane 217, but less than this thickness $e_2$ in order to clamp the peripheral zone 237 of the membrane between the faces 233 and 241. The face 241 thus joins the face 206 of the rim 205 to a plane bottom face 242 which is situated opposite the edge 240 and at a distance $\epsilon_2$ therefrom, and the face 242 is connected to the face 204 by a face 243 which faces the face 234 and is separated therefrom by a distance of at least $\epsilon_2$. The faces 243 and 234 diverge from each other when going away from the edge 240 and the face 242, and they are oriented in such a manner that by bending round the edge 240 and by coming into contact with the first ends 214 of the adjacent tufts 213 closest to the groove 207 the membrane 217 is not subjected to any bending between the bend round the edge 240 and the bend round the tuft 213. This is true both when the tuft is fully extended with its first end 214 pressed against the face 204, as illustrated, and when the tuft is fully retracted under the action of a thrust applied to its second end 215 such that the membrane 217 is urged by the first end 214 against the wall 236.

In this embodiment, the membrane 217 may likewise be plane in shape when its beading is disengaged from the cover 218, i.e. when the membrane is not bent round the edge 240 and over the first ends 214 of the tufts 213. It is then advantageous for the thickness of the membrane $e_2$ to be constant except for its peripheral beading 231 which is of greater thickness.

Naturally, other embodiments of the present invention are also possible without going beyond the scope of the claims.

The choice of material for the membrane 5 (or 117 or 217) and the appropriate thickness therefore are readily determined by the person skilled in the art as a function of the mechanical characteristics, and in particular the elasticity, required for the membrane. For example, the membrane material may advantageously be selected from the group constituted by natural or synthetic latex type elastomers such as polychloroprenes, natural rubber, preferably after being treated to improve its ageing resistance, and silicones. The thickness of the membrane in the relaxed state will generally vary in the range 1 tenth of a millimeter to less than 1 millimeter for toothbrushes, thereby enabling localized or spot resilient deformation with an amplitude of 0.5 mm to 5 mm for a force of about 2 Newtons (N) to 7.5N (i.e. about 200 grams-force to about 750 gf) applied in distributed manner over the set of tufts of bristles in the respective average directions thereof, i.e. in respective directions substantially aligned with the respective axes of the corresponding openings. For example, the possible amplitude of localized elastic deformation in the membrane is about 3 mm under a pressure of about $6.10^4$ Pa (about 6 gf/mm$^2$) between the tufts of bristles 3 and the teeth, for a brush having about thirty tufts. That is to say for a total force applying the brush against the teeth in the average tuft direction of about 2N. (This force is considered typical of the force with which toothbrushes are applied to teeth). The membrane should return to its initial shape after maximum spot deformation under normal tooth-brushing conditions in less than 1 second, and preferably in about 1 tenth of a second. These numerical examples are given with references to a membrane when mounted on a brush head which is provided with tufts of bristles. However, the values should not be considered as being in any way limiting to the application of the invention. Generally speaking, regardless of the field in which the invention is applied, the membrane is preferably selected in such a manner that the tufts retract under the action of contact force against the surface to be brushed and along the average tuft direction which is optimal in the application under consideration, and each tuft should return to its non-retracted position in a period which is compatible with the expected frequency of encounters with irregularities in the surface to be brushed, given the speed with which the brush is normally expected to move over said surface.

I claim:

1. A brush comprising a rigid brush head and a predetermined number of tufts of bristles, with each tuft having a first end held captive in the brush head and a free second end intended to come into contact with a surface to be brushed, the brush head comprising:

a rigid brush head wall having a first face, a second face, and a plurality of openings passing through said wall from the first face to the second face thereof along respective predetermined axes, there being as many of said openings as there are tufts of bristles, and each opening receiving a respective one of said tufts, said tufts being slidable in said openings along respective ones of said axes, each tuft thus being oriented along a corresponding axis and having its second end projecting from the second face of the wall, and an intermediate zone in between said first and second ends which is engaged in a corresponding one of said openings, said intermediate zones and said openings having respective complementary cross-sections in a direction perpendicular to the corresponding axes;

a resiliently deformable membrane capable of spot deformation superposed on the first face of the wall over said openings and said first ends of said tufts, said membrane being independent therefrom, and having a peripheral zone which is fixed over its entire length to said brush head, said membrane being held taut by said brush head;

means for enabling resilient spot deformation of the membrane opposite said openings and said first ends of said tufts, and in a direction away from said first face of the wall;

stop means imposing a limit on the sliding of each tuft in the direction away from said first face towards said second face of the wall to ensure contact between said first end of each tuft and said membrane;

the brush including the improvement whereby said resilient spot deformation of the membrane is defined by said brush head including a cavity facing the set of openings through the wall, said cavity being common to all of said openings and being on the opposite side of said membrane from said first face of the wall, and said membrane being made of an isotropic material and behaving anisotropically in such a manner that the tufts of bristles are capable of retracting resiliently into said cavity independently from one another.

2. A brush according to claim 1, wherein the bristles of each tuft are agglomerated in the said intermediate zone.

3. A brush according to claim 1, wherein the stop means comprise a first end portion at said first end of each tuft, which portion is of greater cross section than said intermediate zone.

4. A brush according to claim 3, wherein said first end portions of greater cross-section are constituted by agglomerating the bristles of each tuft.

5. A brush according to claim 3, wherein each opening comprises two zones of different cross-sections, one of said zones adjacent to said second face of said wall having a cross-section complementary to the cross-section of said intermediate zone of the corresponding tuft, and the other of said zones being adjacent to said first face of said wall and having a cross-section which is complementary to said first end portion of greater cross-section of the responding tuft, said two zones of said opening being interconnected by a stop shoulder for engaging said first end portion.

6. A brush according to claim 1, wherein said wall is applied to said head, and said membrane is clamped between said wall and said head.

7. A brush according to claim 6, wherein said wall and said head are mutually engaged around said first face of said wall by means of a peripheral zone of said membrane.

8. A brush according to claim 1, wherein said wall is an integral part of said head and wherein said cavity is delimited by a cover applied to the head, with a peripheral zone of said membrane being clamped between said cover and said head.

9. A brush according to claim 8, wherein said clamped peripheral zone of said membrane includes a continuous peripheral beading thereon.

10. A brush according to claim 9, wherein the membrane has continuous beading around said clamped peripheral zone and wherein said cover has a continuous peripheral groove for receiving said beading.

11. A brush according to claim 1, wherein the cavity is closed in a sealed manner.

12. A brush according to claim 1, wherein said cavity is open.

13. A brush according to claim 1, wherein said membrane is made from an elastomer material chosen from the group constituted by: natural or synthetic latex type elastomers, in particular polychloroprene; natural rubber; and silicones.

14. A brush according to claim 1, wherein the membrane provides a maximum amplitude of resilient spot deformation in the range 0.5 mm to 5 mm for a force in the range 2N to 7.5N applied over the set of tufts of bristles in respective directions substantially aligned with the axes of the corresponding openings.

15. A brush according to claim 1, wherein the membrane returns to its initial shape in a period of less than 1 second, and preferably in about 1 tenth of a second after maximum spot deformation and under normal conditions of brush usage.

* * * * *